United States Patent [19]

Barker

[11] 4,146,217

[45] Mar. 27, 1979

[54] SHEET FEED MECHANISM FOR OFFSET PRINTING MACHINES AND THE LIKE

[76] Inventor: Roger J. Barker, 2814 Calhoun, Alameda, Calif. 94501

[21] Appl. No.: 802,681

[22] Filed: Jun. 2, 1977

[51] Int. Cl.[2] ..... B65H 3/08

[52] U.S. Cl. ..... 271/108; 271/90; 271/107

[58] Field of Search ..... 271/108, 107, 90, 98, 271/103, 104, 105, 106, 96, 30 R, 30 A, 91, 92, 93; 214/8.5 D

[56] References Cited

U.S. PATENT DOCUMENTS

| | | | |
|---|---|---|---|
| 2,097,587 | 11/1937 | Dearing | 271/91 |
| 2,698,175 | 12/1954 | Rowell | 271/93 X |
| 2,867,438 | 1/1959 | Hori | 271/96 X |
| 3,531,103 | 9/1970 | Walton | 271/98 |
| 3,991,997 | 11/1976 | Barber | 271/108 |

*Primary Examiner*—Bruce H. Stoner, Jr.
*Attorney, Agent, or Firm*—Townsend and Townsend

[57] ABSTRACT

An improved mechanism for feeding paper sheets from a stack by suction, wherein the mechanism includes a manifold provided with a plurality of spaced sheet pickup devices carried by the manifold and in fluid communication therewith. Each device includes a main member having an L-shaped element provided with a flexible suction cup on the lower end thereof. The element is shiftably mounted on and extends through the member for movement fore and aft relative to the member, and is releasably secured to the member in anyone of a number of operative positions relative to the member by a set screw or the like so that the suction cup thereof can be spaced relatively close or relatively far from the member. A preferred embodiment utilizes a U-shaped tube coupled at one end thereof to the element and at the opposite end thereof to a short tube projecting laterally from the member near the upper end thereof. A passage extending downwardly from the upper end of the member to the lateral tube permits fluid communication with the manifold. A valve is shiftably mounted on the member and is movable into and out of a passage-closing position. A locking nut is carried on the upper end of the member for releasably locking the latter to the manifold when the member is threaded into the bottom of the manifold.

6 Claims, 5 Drawing Figures

SHEET FEED MECHANISM FOR OFFSET PRINTING MACHINES AND THE LIKE

This invention relates to improvements in the feeding of sheet material, such as paper sheets in an offset printing machine and, more particularly, to a sheet feeding mechanism having adjustable sheet pickup devices.

BACKGROUND OF THE INVENTION

Paper sheet feed apparatus for offset printing machines and the like have been disclosed in the following U.S. Pat. Nos. 1,575,892; 2,085,592; 2,937,868; 2,986,392; and 3,991,997. All of these patents show sheet pickup devices which are fixed in nature. They cannot be adjusted to accommodate paper sheets of differing weights.

A problem arises oftentimes when paper sheets of different weights are to be fed one-by-one from a stack into an offset printing machine. The stacking apparatus of such a machine has a number of spaced tabs which overlie the leading edge of the upper sheet of the stack to prevent air which blows laterally against the leading edges of the sheets from elevating the upper sheet until it is to be picked up by the suction pickup device. The air helps to prevent the sheets from sticking together.

For relatively lightweight paper, such as 10 to 12 lb. paper, the sheets are so flexible that, when the upper sheet is picked up, it is sometimes held back by the tabs and is stripped of the pickup devices. When this occurs, the sheet is not fed to the pressure and blanket rollers of the machine. Also a lightweight sheet becomes undulating or wavy at its leading edge when picked up; thus, when it is urged forwardly by the pickup devices, it does not feed properly between the blanket and pressure rollers. This causes the sheets to become jammed in the machine and operation of the machine must be halted to remove the sheet.

Because of the foregoing problems, a need has arisen for an improved sheet feed mechanism which can be used with sheets of many different weights so that such sheets can be fed equally well into an offset printing machine without interruption or without becoming jammed in the machine.

SUMMARY OF THE INVENTION

The present invention satisfies the aforesaid need by providing an improved paper feed mechanism whose paper pickup devices can be adjusted to pick up sheets at different locations relative to their leading edges. Thus, more control of the sheet pickup operation can be obtained, especially with sheets of a relatively lightweight nature.

To this end, each sheet pickup device of the mechanism of this invention has a sheet-engaging element which can be shifted fore and aft with reference to the direction of movement of the sheets through a machine so that the pickup device can be closer to or farther away from the leading edge of the stack of sheets as required. For lightweight paper sheets, each device is desirably near the leading edge of the stack so that, while the sheets are quite flexible in nature, their flexibility does not deter their being readily lifted from a stack and fed properly toward the blanket and pressure rollers of an offset printing machine. For relatively heavyweight paper sheets, the suction device can be further away from the leading edges of the sheets.

The primary object of this invention is to provide an improved sheet feed mechanism wherein the mechanism includes a manifold provided with a plurality of suction pickup devices with each device having means for adjusting the fore and aft position of the sheet-engaging part thereof relative to the leading edge of the sheets to be fed from a stack so that the mechanism can be used equally well with sheets of weights in a wide range so as to avoid the problems associated with sheet-feed mechanisms of the prior art.

Another object of this invention is to provide a paper pickup device for a mechanism of the type described, wherein the device includes a main member adapted to be threadably connected to the suction manifold of the mechanism and to extend downardly therefrom with the member being provided with a lateral element shiftably carried thereby for fore and aft movement near the lower end of the member with the element having a suction inlet for engaging the upper sheet of the stack whereby the element can be shifted back and forth into and out of anyone of a number of operative positions and held in an operative position so that the suction inlet can be adjusted with reference to the leading edge of a stack of sheets which are to be fed.

Other objects of this invention will become apparent as the following specification progresses, reference being had to the accompanying drawing for an illustration of an embodiment of the mechanism of the invention.

IN THE DRAWING

Figure 1:
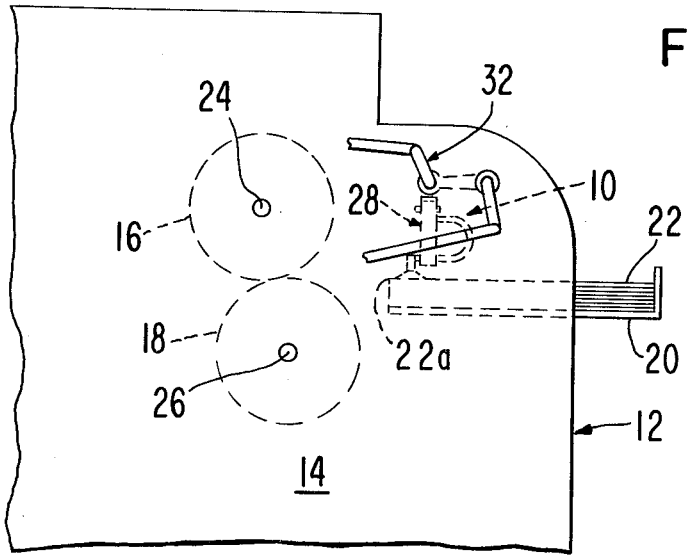
FIG. 1 is a side elevational view of a portion of an offset printer showing the improved sheet feeding mechanism of this invention, portions of the mechanism being shown in dashed lines.

The present invention relates to a sheet feeding mechanism 10 which, for purposes of illustration, is suitable for use with an offset printing machine 12 of the type having a pair of spaced sidewalls 14, impression and blanket rollers 16 and 18, and a sheet-receiving platform 20 for receiving a stack 22 of paper sheets to be printed. Rollers 16 and 18 are mounted between the sidewalls for rotation about the longitudinal axis of a pair of vertically spaced shafts 24 and 26, respectively. Mechanism 10 operates to feed sheets one-by-one from stack 22 to and between rollers 16 and 18 for printing the sheets in a well-known manner. Hold-down tabs (not shown) are provided on the machine near the leading edge of the upper sheet of the stack to hold the sheet until suction pickup devices of mechanism 10 elevate the sheet as hereinafter described. A typical offset printing machine is one made and sold by A. B. Dick Company, 5700 West Touhy Avenue, Chicago, Ill.

Mechanism 10 includes a plurality of sheet pickup devices 28 operated by suction and coupled to a suction source 29 (FIG. 2), the devices being coupled to a suction manifold 30 for upward and rotational movements therewith as the manifold is elevated and then rotated by linkage means broadly denoted by the numeral 32 in FIG. 1, such movements and linkage being conventional on offset printing machines.

Figure 4:
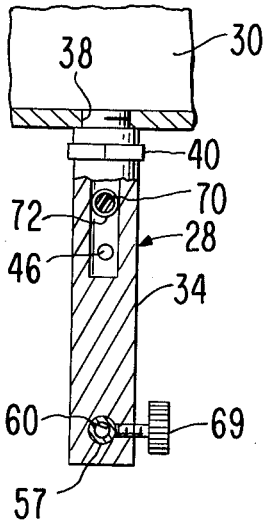
FIG. 4 is a cross-sectional view taken along line 4—4 of FIG. 3.
Figure 5:
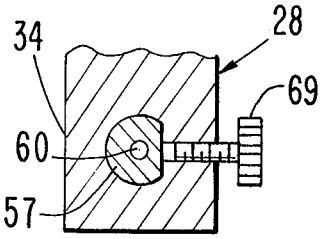
FIG. 5 is an enlarged, fragmentary cross-sectional view similar to FIG. 4 but showing a flat side on a tubular part of the mechanism.

Each device 28 includes a main member 34 which, for purposes of illustration, is provided with a cylindrical, outer surface and is formed from solid stock. Member 34 has a threaded upper end 36 for insertion into a tapped hole 38 in the bottom of manifold 30 as shown in FIG. 4. End 36 is reduced with reference to the outer diameter of member 34 to accommodate a nut 40 having an upper face 42 for engaging manifold 30 to lock the member 34 in a fixed position with respect thereto.

Figure 3:
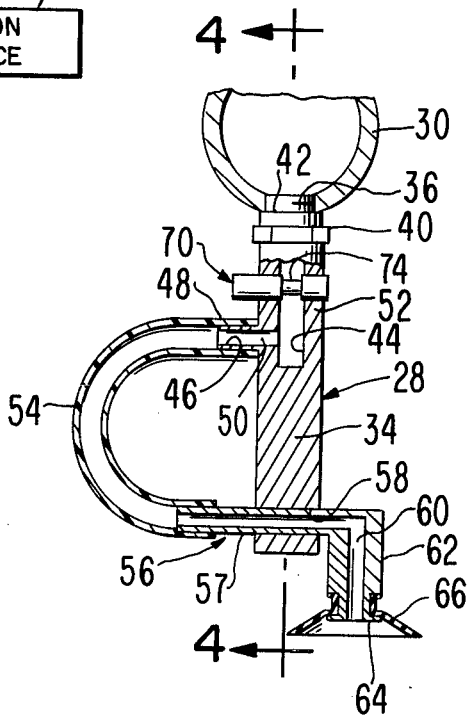
FIG. 3 is an enlarged, vertical section through the mechanism.

Member 34 has a first passage 44 therein extending downwardly from end 36 as shown in FIG. 3. A second, lateral passage 46 communicates with passage 44 and is formed in part by a short tube 48 surrounding a hole 50 through the tubular sidewall 52 at the uper end of member 34. A flexible tube 54 in a U-shaped form is press-fitted on the outer end of tube 48 and extends downwardly where the opposite end of tube 54 is press-fitted over an L-shaped element 56 shiftably extending through member 34 so that element 56 projects laterally from opposed sides of the member. To this end, member 34 has a lateral passage 58 extending therethrough for receiving a horizontal tubular part 57 of element 56, part 57 having a passage 60 therethrough in communication with tube 54.

Figure 2:
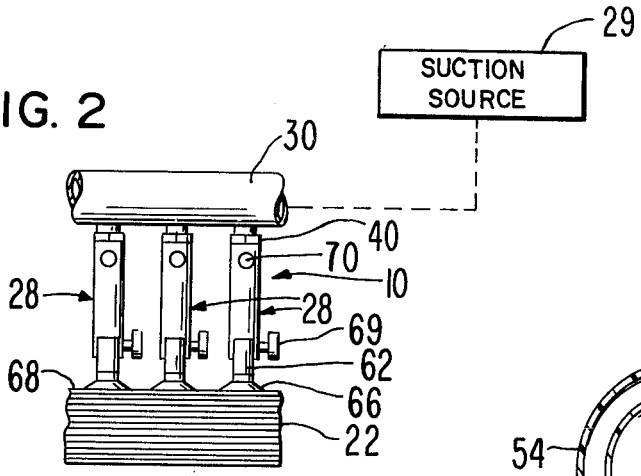
FIG. 2 is an enlarged, fragmentary front elevational view of the mechanism showing the same above a stack of sheets.

The vertical part 62 of L-shaped element 56 is secured to part 57 and has a lower end 64 provided with a resilient suction cup 66 thereon, the latter adapted to engage the upper sheet 68 of stack 22 as shown in FIG. 2 for feeding the sheet toward and between rollers 16 and 18 (FIG. 1).

Since part 57 of element 56 is shiftable in passage 58 and extends fore and aft with reference to the desired direction of movement of the sheets from stack 22, the fore and aft positions of part 62 of element 56 can be adjusted with respect to member 34. Thus, suction cup 66 can be closer or further away from member 34 as desired or deemed necessary. A set screw 69 is threadably coupled to member 34 and bears against part 57 as shown in FIG. 4 to releasably hold element 56 in a fixed position relative to member 34. The side of part 57 engaged by the set screw can be flat so that, when the set screw frictionally engages part 57, part 62 will at all times be vertical for proper feeding of sheets from the stack 22.

A valve 70 is shiftably carried in a pair of holes 72 in the tubular sidewall of member 34 as shown in FIGS. 3 and 4. Valve 70 is slidable in the holes and has a reduced central part 74 which can move into and out of alignment with passage 44. When aligned with the passage, manifold 30 is in fluid communication with tube 54 and thereby passage 60 of element 56. When part 74 is out of alignment, i.e., when one of the enlarged end parts of valve 70 is aligned with passage 44, the passage is closed and there is no fluid communication between manifold 30 and tube 54.

In use, a plurality of devices 38 are coupled to manifold 30 in the manner shown in FIGS. 1-3 with elements 56 extending fore and aft and with vertical parts 62 near the front end of stack 22. The positions of elements 56 of devices 28 will be manually adjusted to accommodate the particular weight of paper used in stack 22. For instance, for lightweight paper, such as 12 lb. paper, elements 56 will be near the leading edge 22*a* of stack 22 so as to be able to pick up the upper sheet 68 without allowing the leading edge of the sheet to be stripped from suction cups 66 or become undulated which would otherwise cause the sheet to be improperly fed toward rollers 16 and 18. When using heavy-weight paper sheets, parts 62 of elements 56 of devices 28 will be spaced rearwardly of leading edge 22*a* because the sheets can be readily fed toward rollers 16 and 18 without having the suction cups 66 near leading edge 22*a*. Operation of the machine can then commence and mechanism 10 will feed sheets one-by-one from stack 22 toward and between rollers 16 and 18.

Adjustments are made by manipulating set screws 69, and elements 56 can be manually shifted back and forth and set in position. Also, parts 62 of elements 56 need not all be placed in the same position relative to leading edge 22*a*. Variations in the positions can be accommodated. Moreover, not all of devices 28 need operate at the same time. For those devices which are not deemed to be necessary to the proper operation of mechanism 10, they can be rendered inoperative by closing the corresponding valves 70. This is done by manually moving each valve 70 until reduced part 74 thereof is out of alignment with passage 44. When this occurs, an enlarged end part of the valve blocks the passage and prevents it from being in communication with manifold 30.

I claim:

1. A paper feed mechanism comprising: a manifold adapted to be coupled to a source of suction and to be shiftably mounted in a generally horizontal position on a machine having a stack of sheets to be fed one-by-one in a predetermined direction; and a plurality of sheet pickup devices coupled with the manifold and extending downwardly therefrom each device comprising an elongated member having an upper end and a lower end and provided with a first passage, a second passage and a third passage, the first passage extending into the member from the upper end thereof and communicating with the manifold, said second passage communicating with the first passage and extending laterally from the inner end thereof to the side of said member, said third passage extending transversely through the member near the lower end thereof, an L-shaped sheet pickup element shiftably received in the third passage and movable fore and aft with reference to the direction of movement of the sheets into anyone of a number of operative positions relative to the member, and a flexible tube carried by the member and coupled to the element for placing the latter in fluid communication with the second passage.

2. A mechanism as set forth in claim 1, wherein said element has an upper part provided with a flat side, and means including a screw carried by the member and releasably engageable with said flat side.

3. A mechanism as set forth in claim 1, wherein is provided a valve carried by the member across said first passage for controlling the fluid flow between the manifold and the element.

4. A paper feed mechanism for a machine having a suction manifold and a stack of sheets to be fed one-by-one in a predetermined direction comprising: a sheet pickup device adapted to be coupled to the manifold and to extend downwardly therefrom, said device comprising an elongated member having an upper end and a lower end and provided with a first passage, a second passage and a third passage, the first passage extending into the member from the upper end thereof and communicating with the manifold, said second passage communicating with the first passage and extending laterally from the inner end thereof to the side of said member, said third passage extending transversely through the member near the lower end thereof, an L-shaped sheet pickup element shiftably received within the third passage and movable fore and aft with reference to the direction of movement of the sheets into anyone of a number of operative positions relative to the member when the member is coupled to the manifold, and a flexible tube carried by the member and coupled to the element for placing the latter in fluid communication with the second passage.

5. A mechanism as set forth in claim 4, wherein said element has an upper part provided with a flat side, and means including a screw carried by the member and releasably engageable with said flat side.

6. A mechanism as set forth in claim 4, wherein is provided a valve carried by the member across said first passage for controlling the fluid flow between the manifold and the element.

* * * * *